US007726507B2

(12) United States Patent
Wickland et al.

(10) Patent No.: US 7,726,507 B2
(45) Date of Patent: Jun. 1, 2010

(54) STORAGE CONTAINER

(75) Inventors: Terry J. Wickland, Evergreen, CO (US); Darold M. Popish, Golden, CO (US); Michael D. Peterson, Parker, CO (US); Fred Louis Popish, Arvada, CO (US)

(73) Assignee: Nuclear Filter Technology, Inc., Golden, CO (US)

( * ) Notice: Subject to any disclaimer, the term of this patent is extended or adjusted under 35 U.S.C. 154(b) by 757 days.

(21) Appl. No.: 11/705,029

(22) Filed: Feb. 12, 2007

(65) Prior Publication Data

US 2007/0246375 A1 Oct. 25, 2007

Related U.S. Application Data

(60) Provisional application No. 60/772,543, filed on Feb. 13, 2006.

(51) Int. Cl.
*B65D 45/28* (2006.01)
*E05C 5/00* (2006.01)

(52) U.S. Cl. ..... 220/327; 220/323; 292/6; 292/7

(58) Field of Classification Search ..... 220/323, 220/327; 292/6, 7
See application file for complete search history.

(56) References Cited

U.S. PATENT DOCUMENTS

| | | | | |
|---|---|---|---|---|
| 380,832 | A * | 4/1888 | Taylor | 292/7 |
| 622,546 | A * | 4/1899 | Shaw | 292/7 |
| 2,355,475 | A * | 8/1944 | Skaller | 220/323 |
| 3,173,572 | A * | 3/1965 | Beecher | 220/323 |
| 3,261,627 | A * | 7/1966 | Jonsson | 292/6 |
| 3,694,145 | A * | 9/1972 | Stevens | 49/318 |
| 4,519,519 | A * | 5/1985 | Meuschke et al. | 220/211 |
| 4,534,488 | A * | 8/1985 | Boggs et al. | 220/323 |
| 4,891,910 | A * | 1/1990 | Cook et al. | 49/395 |
| 4,921,123 | A * | 5/1990 | Mizioch | 220/323 |
| 5,725,645 | A | 3/1998 | Wickland et al. | |
| 5,727,707 | A | 3/1998 | Wickland et al. | |
| 5,814,118 | A | 9/1998 | Wickland et al. | |
| 5,911,332 | A | 6/1999 | Wickland et al. | |
| 6,355,078 | B1 | 3/2002 | Wickland | |
| 6,395,050 | B1 | 5/2002 | Wickland et al. | |
| 6,413,304 | B1 | 7/2002 | Wickland et al. | |
| 6,557,428 | B2 | 5/2003 | Wickland et al. | |
| 6,911,061 | B2 | 6/2005 | Peterson et al. | |
| 6,935,199 | B2 | 8/2005 | Wickland et al. | |
| 6,948,391 | B2 | 9/2005 | Brassell et al. | |
| 7,048,139 | B1 | 5/2006 | Peterson et al. | |

OTHER PUBLICATIONS

U.S. Appl. No. 11/727,169, Wickland et al.
U.S. Appl. No. 11/705,028, Wickland et al.

* cited by examiner

*Primary Examiner*—Anthony Stashick
*Assistant Examiner*—Niki M Eloshway
(74) *Attorney, Agent, or Firm*—Millen, White, Zelano & Branigan, P.C.

(57) ABSTRACT

A container for hazardous wastes, such as, plutonium wastes, includes a can and a lid wherein the lid is locked to and sealed with respect to the can by radially projected locking bolts. In order to lock the lid to the can the bolts are cammed radially by rotating a U-shaped handle to place the locking bolts behind a locking rim at the mouth of the can. The bolts are then pivoted to apply an axial force to the locking rim to urge the lid against a gasket to seal the lid by turning a threaded axial force element to pivot the locking bolts on the fulcrums.

16 Claims, 5 Drawing Sheets

STORAGE CONTAINER

This application claims the benefit of the filing date of U.S. Provisional Application Ser. No. 60/772,543 filed Feb. 13, 2006.

FIELD OF THE INVENTION

The present invention relates to storage containers. More particularly, the present invention relates to storage containers especially useful for storing radioactive materials, such as plutonium in the form of oxides and salts, as well as in other forms.

BACKGROUND OF THE INVENTION

Plutonium is a man-made radioactive element which is used as an explosive ingredient in nuclear weapons and as a fuel for nuclear reactors. It has the important nuclear property of being readily fissionable with neutrons and is available in relatively large quantities. Caution must be exercised in handling plutonium to avoid unintentional formation of critical mass. Plutonium in liquid solutions is more apt to become critical than solid plutonium so it is also very important to avoid the unintentional creation of a liquid solution. Since plutonium is considered to be highly carcinogenic, it is important that plutonium in any form be contained and not escapes into the surrounding environment where it can be inhaled or otherwise ingested by humans or other living things. Frequently, plutonium oxides and salts are in the form of powders which require very special handling to ensure that particles do not become suspended in the air and that liquid does not come into contact with the powders. Optionally, such containers are vented through high efficiency particulate filters.

SUMMARY OF THE INVENTION

The present invention relates to a storage container for radioactive materials and comprises a housing with a lid wherein the lid is locked to the housing by cam-projected bolts, which extend radially with respect to the axis of the housing. The radially projected bolts are driven by a central cam that is attached to the bolts with pin and slot couplings. A locking nut pivots the bolts in order to apply force to urge the lid against a seal having an axial sealing surface and to seal a seal having a radial sealing surface. A locking pin is provided to keep the locking bolts projected into an inwardly facing groove on the housing at the mouth of the housing as well as to keep the bolts in a position to apply pressure to the axial sealing surface.

DETAILED DESCRIPTION

Figure 1:
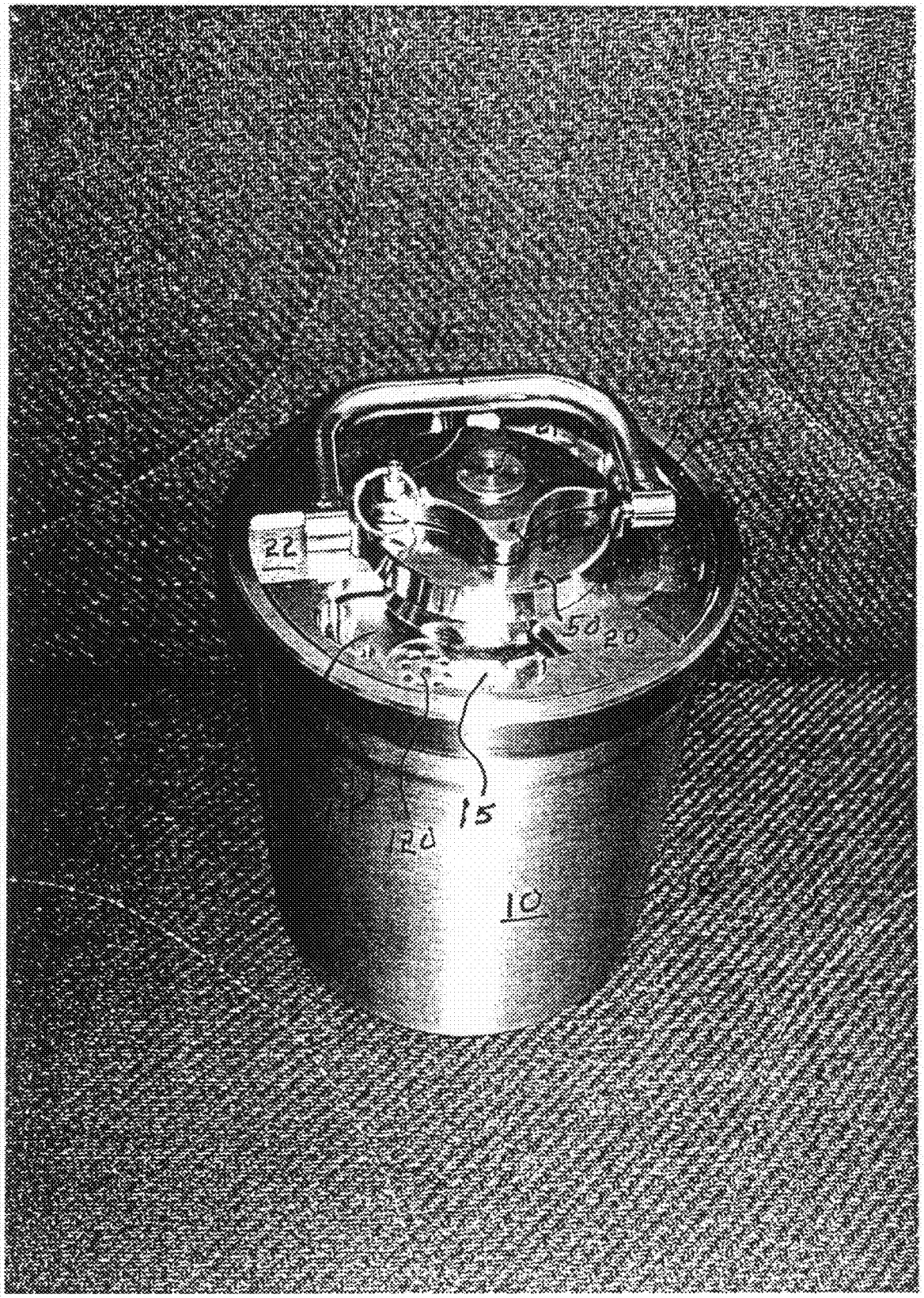
FIG. 1 is a perspective view of a container configured in accordance with the principles of the present invention.
Figure 2:
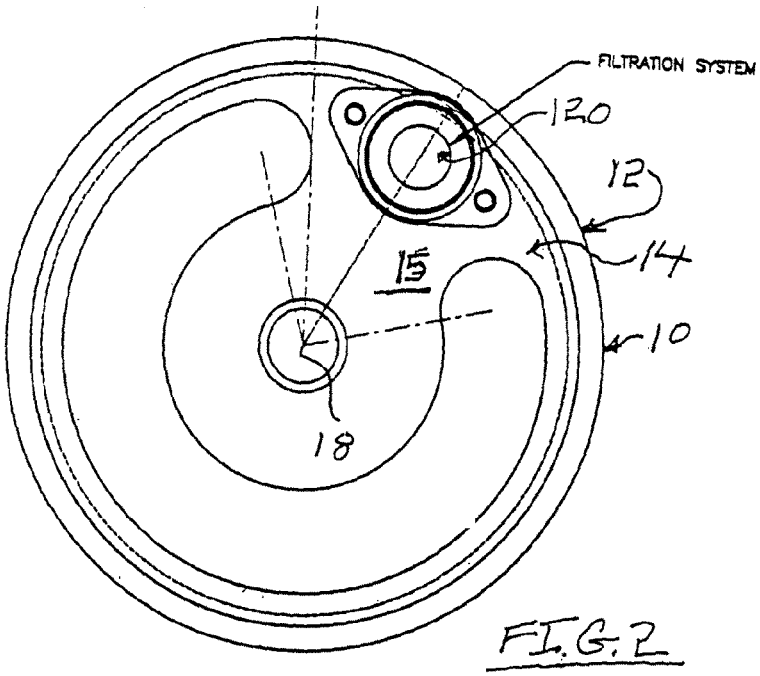
FIG. 2 is a top view of the lid of the container of FIG. 1.
Figure 3A:
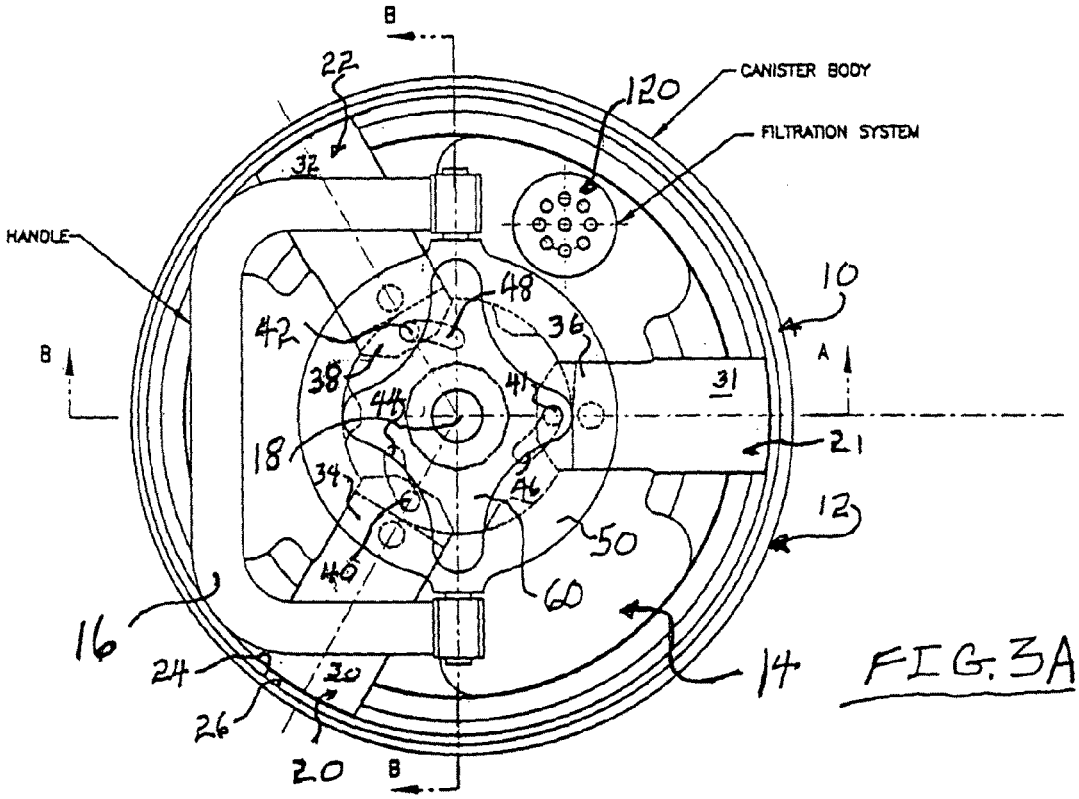
FIG. 3A is a top view of a locking mechanism for the lid.
Figure 3B:
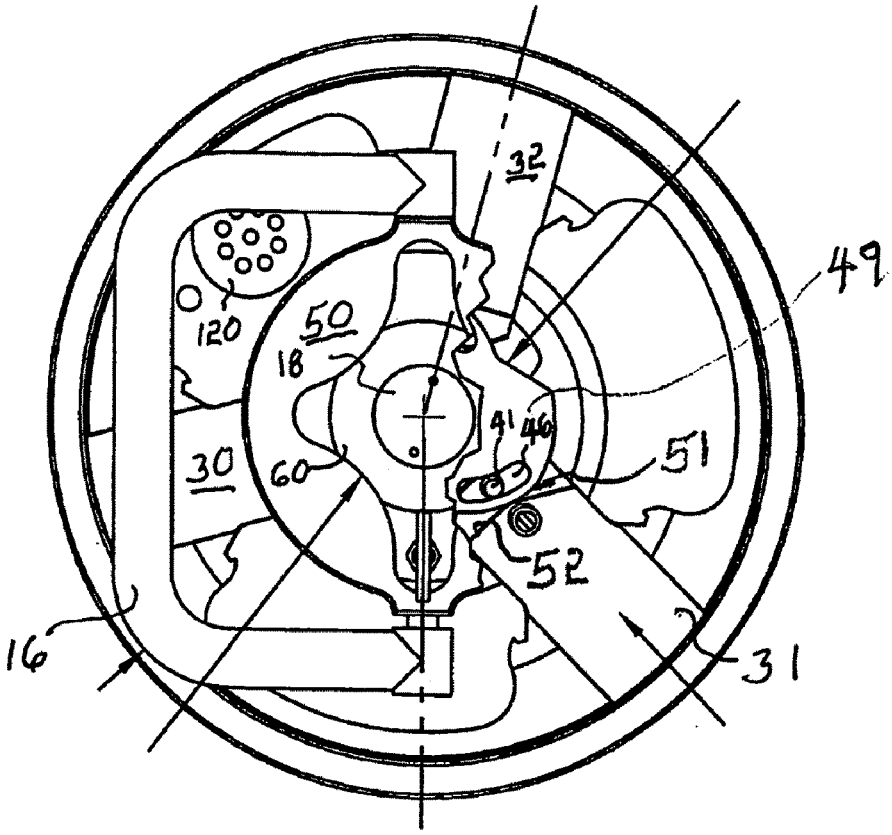
FIG. 3B is a tip view of the locking mechanism with portions broken away to show camming arrangements for locking bolts.
Figure 4:
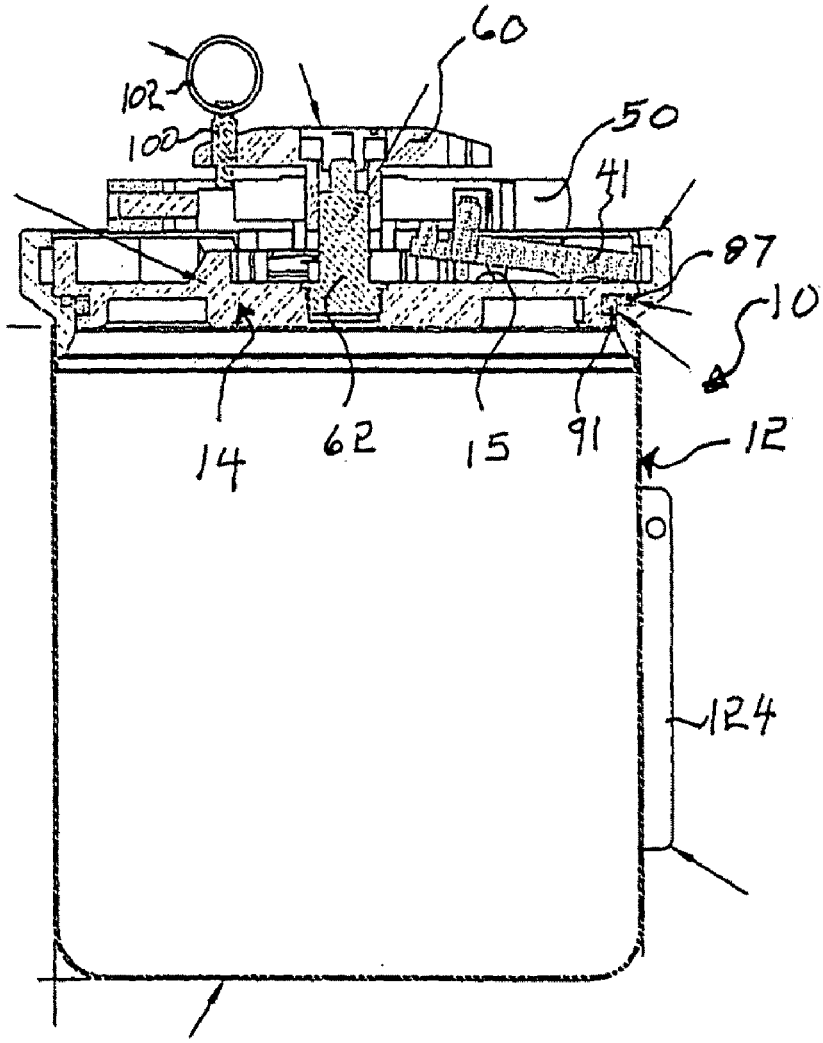
FIG. 4 is a side elevation of the container of FIGS. 1-3.

Referring now to FIG. 1 there is shown a container 10 for containing waste material such as, but not limited to, waste radioactive materials such a plutonium in the form of oxides and/or salts. The container 10 comprises a housing 12 made of stainless steel or aluminum or tool steel. The housing 12 is closed by a lid 14 made of a material similar to the housing and having a top surface 15. Attached to the lid 14 is a locking and carrying handle 16 which is preferably U-shaped in configuration and is rotated with respect to the axis 18 of the cam to project bolts 20, 21 and 22 into an inwardly facing groove 24 having a top surface 25 forming a locking rim at the mouth 26 of the housing 10. Preferably, the handle 16 is U-shaped and is pivoted to fold to a substantially horizontal orientation with respect to the lid 14 of the container 10.

Referring now primarily to FIGS. 2-6, it is seen that the locking bolts 20-22 have projecting ends 30-32 that fit in the slot 24 adjacent the mouth 26 of the housing 12 when projected. The bolts 20-22 also have inner ends 34, 36 and 38 that have pins 40, 41 and 42 projecting perpendicularly with respect to the surfaces of the bolts. The pins 40-42 are received in a cam portion 49 of a rotating cam plate 50 and are advanced by cam slots 44, 46 and 48 as the U-shaped handle 16 is turned to drive the locking bolts 20-21 in radial directions. The pin-in-slot connections 40-42 and 44, along with the U-shaped handle 16 for a first camming arrangement. The cam portion 49 also has cam surfaces 51 that engage abutting cam follower surfaces 52 on locking bolts 20-22 stabilize and project the locking bolts radially. The locking bolts 20-21 are pivoted on fulcrums 55 from the position of FIG. 5 to that of FIG. 6. This is accomplished by pressing against the inner ends 34, 36 and 38 of the locking bolts 20, 21 and 22 to cause inner ends of the locking bolts to move down toward the upper surface 15 of the lid 14 which raises the end portions 30, 31 and 32 to engage against the lower surface 25 of the groove 24 in the mouth 26 of the housing 12.

In the illustrated embodiment, pressing the inner ends 34, 36 and 38 of the locking bolts 20-22 is done by rotating a locking nut 60 that is mounted on course threads 62 of an axial bolt 64 that is non-rotatably retained in a recess 66 in the cover 14. Rotating the locking nut 60 advances the rotatable cam plate 50 in the direction of axis 18 toward the outer surface 15 of the lid 14. This cam plate thus serves as an axial force element that causes the top surfaces of the pins 40, 41 and 42 to be engaged by surfaces 70 at the top of arcuate cam slots 44, 46 and 48 and presses the inner end portions 34, 36 and 38 of the radially lock bolts 20, 21 and 22 downwardly to lift the outer end portions 30, 31 and 32 into engagement with the top surface 25 of the groove 24 at the mouth 26 of the housing 10. As the bolts 20, 21 and 22 rotate on the fulcrums 55, a resilient O-ring seal 87 is compressed and sealed against the bottom surface 88 of the lid 14 as it is compacted in the slot 89. A resilient radial O-ring seal 90 seals radially against the inner surface 91 of housing 12.

Figure 5:
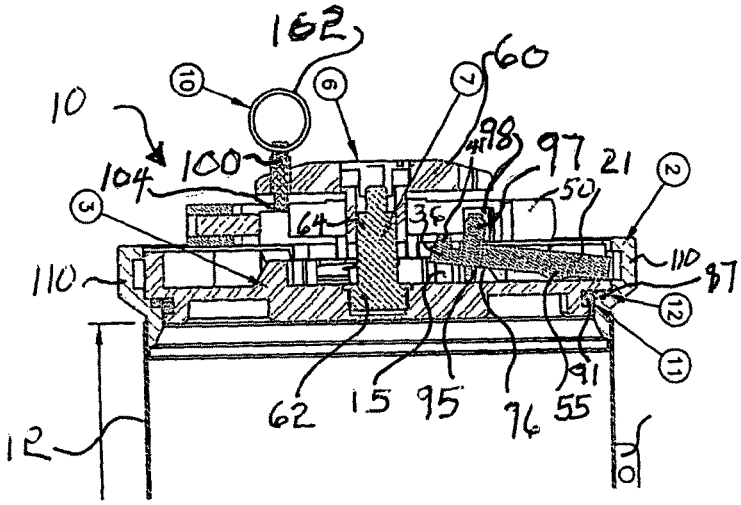
FIG. 5 is a side elevation of locking bolt positions prior to sealing the lid on the housing.
Figure 6:
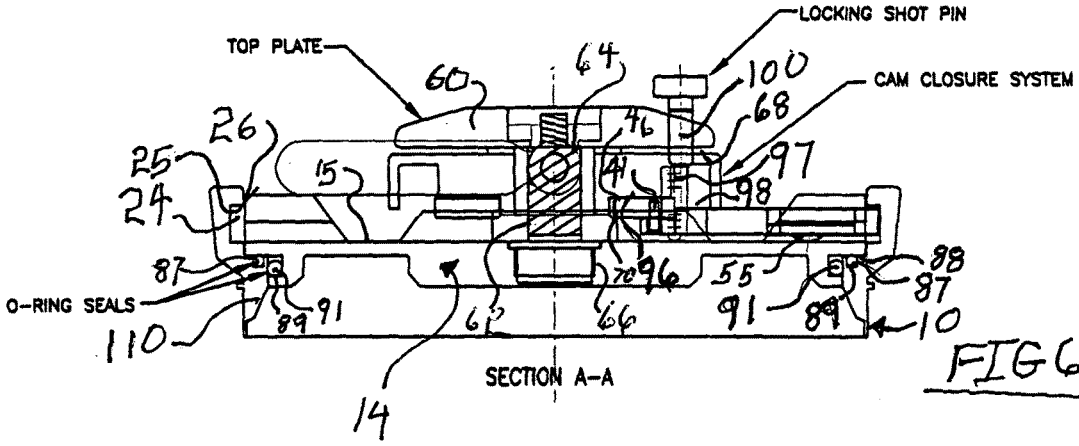
FIG. 6 is a side elevation of the locking bolt positions subsequent to sealing the lid on the housing.

In order to bias the radial locking bolts 20-22 to the FIG. 5 position where the locking bolts are tilted away from the top surface 25 of the groove 24, a spring biased projection 95 extends from the lower surface 96 of each of the bolts and engages the top surface 15 of the lid 14 to lift the inner portions 34, 36 and 38 of the locking bolts. Once the locking bolts 20-22 have been driven into the groove 24, as shown in FIG. 6, by rotating the cam 50 through about 10° with the U-shaped handle 16, turning the locking nut 60 overcomes the bias of spring projected pins 95. The spring projected pins 95 have ends 97 which are received in recesses 98 in the cam 50.

A locking pin 100 having a pull ring 102 extends through the locking nut 60 and is received in an opening 104 in cam 50 to lock the locking nut 60 to the cam 50 after the locking bolts 20-22 have been pivoted to compress the O-ring seal 87.

A preferable configuration for the mouth 26 of the housing 12 is a separate rim 110, which has an annular flange 112 that is welded to the open end of the housing 12 as seen in FIG. 5.

A filter 120 is placed in the lid 14 to trap particulates entrained in any fluid venting from the container 10.

In addition to the U-shaped handle 16, there is at least one grip handle 124 which projects from the side of the housing 10. Preferably, there are a plurality of grip handles 124.

The container 10 is made in different sizes, for example, 1 to 12 quart sizes and a 7 gallon size.

We claim:

1. A container for hazardous materials comprising:

a can having a closed end and an open end;

a locking rim located at the open of the cam, the locking rim having a shelf therein of a first inner diameter;

a lid having an outer surface and an inner surface, the lid having an outer diameter larger than the inner diameter of the shelf wherein when the lid is mounted on the cam the lid is supported on the shelf;

at least one gasket between the shelf and the inner surface of the lid;

an array of radially extending locking bolts having inner and outer portions and being slidably mounted on the lid for sliding the outer portions between the locking rim on the housing and the lid;

a first camming arrangement connected to the inner portions of the locking bolts to project the outer portion of the locking bolts beneath the locking rim when rotated;

a fulcrum between each sliding bolt and the top surface of the lid;

a second camming arrangement for engaging the inner portion of the locking bolts to pivot the locking bolts about the fulcrums to move the outer portions into engagement with locking rim and force the lid against the gasket to seal the hazardous materials within the container from the surrounding environment.

2. The container of claim 1 wherein the first camming arrangement has a handle attached thereto for operation of the camming arrangement.

3. The container of claim 2 wherein the handle pivots with respect to the lid to lie thereagainst when not in use.

4. The container of claim 3 wherein the handle is connected to a cam plate assembly forming part of the camming arrangement and wherein the handle rotates the cam plate assembly to cam the locking bolts in a radial direction through camming connection between the cam plate and the inner portions of the bolts.

5. The container of claim 4 wherein the second camming arrangement utilizes the cam plate assembly to urge the cam plate against the inner portions of the locking bolts to pivot the locking bolts on the fulcrums to engage the inner portions with the locking rim to force the lid against the gasket.

6. The container of claim 5 wherein the fulcrums are integral with the locking bolts.

7. The container of claim 4 wherein the camming connections between the cam plate assembly and the locking bolts is a pin-in-slot connection with a portion of the cam plate assembly.

8. The container of claim 7 wherein the gasket comprises both a radially compressed gasket element and an axially compressed gasket element.

9. The container of claim 1 wherein the second camming arrangement the cam plate assembly to urge a portion of the cam plate assembly against the pins of the locking bolts to pivot the locking bolts on the fulcrums to engage the inner portions with the locking rim to force the lid against the gasket.

10. The container of claim 9 wherein the fulcrums are integral with the locking bolts.

11. The container of claim 10 wherein the axial force element is threaded into the lid and applies force to the cam plate assembly upon being rotated to advance axially toward the lid.

12. The container of claim 11 wherein the handle for actuating the first camming arrangement is U-shaped and the axial force element is straddled by the handle.

13. The container of claim 12 wherein the fulcrums are integral with the locking bolts.

14. The container of claim 13 wherein the camming connections between the cam plate assembly and the locking bolts is a pin-in-slot connection.

15. The container of claim 14 wherein the gasket comprises both a radially compressed gasket element and an axially compressed gasket element.

16. The container of claim 1 wherein the gasket comprises both a radially compressed gasket element and an axially compressed gasket element.

* * * * *

UNITED STATES PATENT AND TRADEMARK OFFICE

CERTIFICATE OF CORRECTION

PATENT NO. : 7,726,507 B2
APPLICATION NO. : 11/705029
DATED : June 1, 2010
INVENTOR(S) : Wickland et al.

It is certified that error appears in the above-identified patent and that said Letters Patent is hereby corrected as shown below:

Column 3, line 18 reads "a locking rim located at the open of the cam, the locking rim" should read -- a locking rim located at the open end of the can, the locking rim --

Column 3, line 22 reads "of the shelf wherein when the lid is mounted on the cam" should read -- of the shelf wherein when the lid is mounted on the can --

Signed and Sealed this

Tenth Day of August, 2010

David J. Kappos

David J. Kappos
*Director of the United States Patent and Trademark Office*